US005873707A

United States Patent [19]

Kikuchi

[11] Patent Number: 5,873,707

[45] Date of Patent: Feb. 23, 1999

[54] FLUID DISPLACEMENT APPARATUS WITH VARIABLE DISPLACEMENT MECHANISM

[75] Inventor: Toshiyuki Kikuchi, Isesaki, Japan

[73] Assignee: Sanden Corporation, Gunma, Japan

[21] Appl. No.: 561,713

[22] Filed: Nov. 22, 1995

[30] Foreign Application Priority Data

Nov. 29, 1994 [JP] Japan ..... 6-294532

[51] Int. Cl.[6] ..... F04B 49/00

[52] U.S. Cl. ..... 417/309

[58] Field of Search ..... 417/309

[56] References Cited

U.S. PATENT DOCUMENTS

| | | |
|---|---|---|
| 3,759,057 | 9/1973 | English et al. . |
| 4,382,370 | 5/1983 | Suefuji et al. . |
| 4,459,817 | 7/1984 | Inagaki et al. . |
| 4,566,863 | 1/1986 | Goto et al. . |
| 4,642,034 | 2/1987 | Terauchi . |
| 4,673,340 | 6/1987 | Mabe et al. . |
| 4,717,314 | 1/1988 | Sato et al. . |
| 4,744,733 | 5/1988 | Terauchi et al. . |
| 4,747,756 | 5/1988 | Sato et al. . |
| 4,904,164 | 2/1990 | Mabe . |
| 4,940,395 | 7/1990 | Yamamoto et al. . |
| 5,240,388 | 8/1993 | Matsumoto et al. . |

FOREIGN PATENT DOCUMENTS

| | | |
|---|---|---|
| 0144169 | 6/1985 | European Pat. Off. . |
| 0297840 | 1/1989 | European Pat. Off. . |
| 3804418 | 10/1988 | Germany . |
| 60-101295 | 6/1985 | Japan . |
| 63-212789 | 9/1988 | Japan . |

*Primary Examiner*—Charles G Freay
*Attorney, Agent, or Firm*—Baker & Botts, L.L.P.

[57] ABSTRACT

A control mechanism for a fluid displacement apparatus is disclosed. The control mechanism controls fluid communication between an intemediate pressure chamber and a suction chamber of the fluid displacement apparatus, which has a communication channel extending between the intermediate pressure chamber and the suction chamber. The mechanism includes a first valve element having a cylinder and a piston slidably disposed within the cylinder between positions corresponding to maximum and reduced displacement of the compressor. This movement defines a maximum amplitude of the compressor. The cylinder has a bottom wall seperating the cylinder chamber from the suction chamber. A hole is formed in a wall between the cylinder chamber and the intermediate pressure chamber. A distance between the bottom wall and the hole is designed to be greater than the maximum amplitude to prevent the piston from striking the bottom wall. Different shapes may be used for the hole to change the nature of the transition from maximum to reduced displacement.

8 Claims, 3 Drawing Sheets

FLUID DISPLACEMENT APPARATUS WITH VARIABLE DISPLACEMENT MECHANISM

BACKGROUND OF THE INVENTION

1. Field of the Invention

This invention relates to a scroll-type refrigerant compressor having a variable displacement mechanism.

2. Background

Compressors used in automotive air conditioning systems are typically driven by an automobile engine'power, which transmitted to the compesssor through an electromagnetic clutch. If the compressor is not provided with a variable displacement mechaniam, and if the engine is rotating at a high rate, the compressor will be driven at a high rate as well and the operating capacity of the compressor may be larger than necessary. The electromagnetic clutch operates to ensure proper functioning of the compressor. However, under these conditions, the operation of the electromagnetic clutch can cause a large change in the load on the engine, thereby reducing the speed and acceleration performance of the automobile.

A solution to this problem is to provide the compressir with a variable displacement mechanism. Scroll-type compressors having variable displacement mechanisms for varying the compressor capacity are generally known is the art. Such a compressor is disclosed, for example, in U.S. Pat. No. 4,904,164 issued to Mabe et al.

With reference to FIG.1 a scroll-type compressor includes housing 10 having a front end plate 11 and a cup-shaped casing 12, which is attached to a end surface of front end plate 11. An opening 111 is formed in the center of front end plate 11 and drive shaft 13 is disposed in opening 111 is formed in the center of front end plate 11 and drive shaft 13 is disposed in 111. An annular projection 112 extends from a rear end surface of front end plate 11. Annular projection 112 faces cup-shaped casing 12 and is concentric with opening 111. Annular projection 112 extends into cup-shaped casing 12, such that an outer peripheral surface of annular projection 112 is adjacent an inner wall surface of opening 121 of cup-shaped casing 12. Opening 121 of cup-shaped casing 12 is thus covered by front end plate 11. An O-ring 14 is placed between the outer peripheral surface of annular projection 112 and the inner wall surface of opening 121 of a cup-shaped casing 12 to seal the mating surfaces thereof. An annular sleeve 16 longitudinally projects forward from a front end surface of front end plate 11. sleeve 16 surrounds a portion of drive shaft 13 and partially defines a shaft seal cavity 161. A shaft seal assembly 18 is coupled to drive shaft 13 within shaft seal cavity 161 of annular sleeve 16. Drive shaft 13 is rotatably supported by annular sleeve 16 through a bearing 17 located within a front end of annular sleeve 16. Drive shaft 13 has a disk-shaped rotor 131 at its rearward end. Disk-shaped rotor 131 is rotatably supported by front end plate 11 through a bearin 15 located within opening 111 of front end plate 11.

A pulley 201 is rotatably supported by a bearing 19, which is disposed on the outer peripheral surface of annular sleeve 16. An electromagnetic coil 202 is fixed by a support. plate about the outer surface of annular sleeve 16 and is disposed within pulley 201. An armature plate 203 is elastically supported on the forward end of drive shaft 13. Pulley 201, electromagnetic coil 202 and armature plate 203 from an electromagnetic clutch 20.

A fixed scroll 21, an orbiting scroll 22 and rotation preventing/thrust bearing mechanism 24 for orbiting scroll 22 are disposed in the interior of housing 10. Fixed scroll 21 includes a circular end plate 211 and a spiral element 212 affixed to and extending from a forward end surface of circular end plate 211. Fixed scroll 21 is fixed within cup-shaped casing 12 by screws (not shown),which are screwed into circular end plate 211 from the exterior of cup-shaped 12. Circular end plate 211 divides the interior of housing 10 into a front chamber 27 and a rear chamber 28,Spiral element 212 of fixed scroll 21 is located within front chamber 27.

A partition wall 122 longitudinally projects from the inner end surface of the rear portion of cup-shaped casing 112 to divide rear chamber 28 into a discharge chamber 281 and an intemediate pressure chamber 282. The foward end surface of partition wall 122 contacts the rear end surface of circular end plate 211.

Orbiting scroll 22, which is located in front chnaber 27, includes a circular end plate 221 and a spiral element 222 extending from a rear end surface of circular end plate 221. Spiral element 222 of orbiting scroll 22 and spiral element 212 of fixed scroll 21 interfit at an extending from a rear end surface of circular end plate 221. angular offset of approximately 18 degrees and a predetermined radial offset to form a plurality of sealed spaces between spiral element 212 and 222. Orbiting scroll 22 is rotatably supported by a bushing 23, which is exxentrically connected to the inner end of disc-shaped rotor 131 through a radial needle bearing 30. While orbiting scroll 22 orbits, rotation therof is prevented by rotation preventing/thrust bearing mechanism 24, which is placed between front end plate 11 and circular end plate 221 of orbiting scroll 22.

Compressor housing 10 is provided with an inlet port 31 and an outlet port 32 for connecting the compressor to an external refrigeration circuit (not shown). Refrigeration fluid from the external refrigeration circuit is introduced into suction chamber 271 through inlet port 31 and flows into the puluality of sealed spaces formed between spiral elements 212 and 222. The fluid then flows through the spaces between the spiral elements. The plurality of sealed spaces between the spiral elements sequeentially open and close during the orbital motion of orbiting scoll 22. When these spaces are open, fluid to be compressed flows into these spaces. When the spaces are closed,no additional fulid flows into these spaces and commpression begins. The outer terminal ends of spiral elements 212 and 222 terminate at a final involute angle, and the location of the plurality of spaces is directly related this final involute angle. Furthermore, refrigeration fluid in the sealed spaces is moved radially inward and is compressed by the orbital motion of orbiting scroll 22. Compressed refrigeration fluid at a central sealed space is discharged to discharge chamber 281 past valve plate 231 through dischange port 213 formed at the center of circular end plate 211.

A pair of holes (only one hole is shown as hole 214) are formed in circular end plate, 211 of fixed scroll 21 and are symmetrically placed so that an axial end surface of spiral element 222 of orbiting scroll 22 simultaneously cross over both holes. Hole 214 (and the other hole not shown)provide fluid communication between the plurality of sealed spaces and intermediate pressure chamber 282. Hole 214 is placed at a position defined by involute angle ($\phi_1$ )(not shown) and opens along a radially inner side wall of spiral element 212. The other hole is placed at a position defined by involute angle($\phi_1$ $\pi$)and opens along a radially outer side wall of spiral element 212. A pair of valve plates (only one valve plate is shown as valve plate 341) are attached by fasteners (not shown)to the rear end surface of circular end plate 211 opposite hole 214 and the other hole, respectively. Valve plate 341 and the other valve plate (not shown)are made of a material having a spring constant which biases valve plate 341 and the other valve plate against the opening of hole 214 (and the other holes)to close these holes. When a valve plate is forced open due to a pressure difference between the jpressure in front chamber 27 and rear chamber 28, a valve retainer (not shown)receives the valve plate to prevent excessive bending of the valve plate. Excessive bending of the valve plate can cause damage to the valve plate.

Circular end plate 211 of fixed scroll 21 also has communicating channel 29 formed therein and located at a radially outer side portion of the terminal end of spiral element 212. Communicating channel 29 provides fluid communication between suction chamber 271 and intermediate pressure chamber 282. A control mechanism 36 controls fluid communication between suction chamber 271 and intermediate pressure chamber 282. Control mechanism 36 comprises a first valve element 37 having a cylinder 371 and a piston 372 slidably disposed within cylinder 371. Control mechanism 36 also comprises a second valve element 38.

A first opening 373,which opens to intermediate pressure chamber 282,is formed through a side wall of cylinder 371. A second opening 374,which opens to communicating channel 29,is formed at a bottom portion of cylinder 371.A ring member 61 having a sealing function is disposed on a rear surface 122 *a* of partition wall 122 located at the bottom portion of cylinder 371. An annular projection 376 forwardly projects from the bottom of the portion of poston 372. A plurality of communicating holes 377 are formed in axial annular projection 376 to provide fluid communication between the interior of piston 372 and space 60. A bias spring 39 is disposed between a rear end surface of circular end plate 211 and the bottom portion of piston 372 to urge 327 toward a ceiling 379 of cylinder 371. An opening 63 is formed in cup-shaped casing 12 and opens into space60.Opening 63 is normally blocked by a plug 62.

A hollow portion 378 is formed of an inner surface of ceiling 379 of cylinder 371. Portion 378 is formed such that it exists even if top portion 375 of piston 372 contacts the inner surface of ceiling 379 of cylinder 371. This configuration allows discharge gas to pass into cylinder 371. An orifice tube 63 is disposed in the side wall of cylinder 371 to lead discharge gas to hollow portion 378 from discharge chamber 281.

Second valve element 38 comprises a bellows 381.A needle ball-type valve 382 is attached to a rear end of bellows 381 by pin member 383,and is disposed within piston 372. The bottom of bellows 381has a screw portion 384,which screws into an inner surface of axial annular projection 376. Screw portion 384 can be screwed in or out to adjust an intital condition of bellows 381. A valve seat 385 is formed at the upper portion of piston 372. A bias spring 386 is disposed within valve seat 385 and urges needle ball type valve 382 forward toward screw portion 384. In addition,a sealing member 71 is disposed at a upper portion of the outer peripheral wall of the piston 372 to seal a gap between an inner peripheral surface of cylinder 371 and the outer peripheral wall of piston 372.

The operation of control mechanism 36 is as follows. When the compressor is not in operation,piston372 is positioned as shown in FIG.1 because bias spring biases piston 372 rearward toward ceiling 379. When the compressor is in operation,and is driven in a condition in which the suction pressure is relatively high (i.e.,the load is relatively great) bellows 381 is compressed and contracts because refrigerant gas at suction pressure is led into the interior space of piston 372 from communicating channel 29 through communicating holes 377. As a result,needle ball-type valve 382 moves forward to block valve seat 385. Therefore, discharge gas pressure led into cylinder 371 through orifice tube 63 fills hollow portion 378 to urge piston 372 forward toward cicular end plate 211 against the restoring force of bias spring 39. Piston 372 moves forward,and if the heat load is high enough poston 372 blocks first and second openings 373 and 374,thereby preventing communication between sucrion chamber 271 and intermediate pressure chamber 282 as shown,for example,in FIG.2. Therefore,the pressure in intermediate pressure chamber 282 to gradually increased due to fluid passing from intermediate pressure chamber 282 to sealed space 272 through hole 214 and the other above-described hole (not shown). This passage of compressed fluid contuines until the pressure in intermidiate pressure chamber 282 is equal to the pressure in sealed space 272. When pressure equalization occurs,hole 214 and the other hole are closed by the spring characyeristic of valve plates 341 and the other above-described valvel plate (not shown) ,respectively. Compression then continues normally and displacement volume of sealed spaces is the same as the displacement volume when the terminal end of each of spiral elements 212 and 222 first contacts the other spiral element. In this situation,the forward bias of piston 372 caused b the discharge gas pressure on the rearward side of top portion 375 fully overcomes the rearward bias of piston 372 caused by suction pressure and the restoring force of bias spring 39.

As the heat load decreases,continuation of this non-reduced displacement compression results in a decrease in the suction pressure. As a result,bellows 381 is expanded by the reduced suction pressure gas,which passes into the interior space of piston 372 from communicating channel 29 through comminication holes 377. Therefore,needle ball-type valve 382 moves rearward toward celing 379 to open valve seat 385. When valve seat 385 is opened, discharge gas led into hollow portion 378 through orifice tube 63 passes through valbe seat 385, through the interior of piston 372,and through communication holes 377 to communicating channel 29. Conquently,the pressure on the rearward side of top portion 375 is reduced and the rearward bias of piston 372,caused by the suction pressure and the restoring force of bias spring 39,overcomes the forward bias of piston 372. As first and second openings 373 and 374 are opened, communication between suction chamber 271 and intermediate pressure chamber 282 is restored.

When suction chamber 271 communicates with intermediate pressure chamber 282,the pressure of intermediate pressure chamber 282 is greatly reduced.Thus, valve plate 341 (and the other valve plate)is opened by virtue of the pressure difference between sealed space 272 and intermediate pressure chamber 282. This allows the refrigeration fluid in intermediate sealed space 272 to flow into intermediate pressure chamber 282 through hole 214 (and the other above-described hole),and back into suction chamber 271. The compression phase of the compressor begins after spiral element 222 of orbiting scroll 22 passes over hole 214 and the other hole. In this situaltion,the compression ratio of the compressor is greatly reduced and the compressor operates at a displacement which is less than maximum displacement.

As the displacement of the compressor transitions from maximum displacement. to a reduced displacement,as describe above,the pressure in suction chamber 271 increases Also,the pressure o the rearward side of top portion 375 quickly decreases since discharge gas introduced into cylinder 371 rapidly flows into suction chamber 271 through communication holes 377. As a result,bellows 381 is contracted by increased pressure of fluid which is led into the inner space of piston 372 from communication channel 29 holes 377. Needle ball-type valve 382 once again blocks valve seat 385 . Therefore,discharge pressure led into cylinder 371 through orifice tube 63 once again presses against the rerward side of top portion 375 of piston 372 forward against the restoring force of bias spring 39.

However,this rapid increase in pressure with the communication channel 29 is temporary and,in fact,the suction chamber pressure has been reduced due the decreased heat load. Therefore,the pressure in communication channel 29 (and therefore the pressure in the interior of piston 372)is soon reduced causing piston 372 to again move rearward.

Therefore,as the compressor operation transitions from maximum displacement to a reduced displacement,as described above,piston 372 vibrates axially at a certain amplitude and period within cylinder 371. This vibration gradually decreases to zero and athe compressor continues to function normally at the reduced displacement. In the configuration shown in FIG.1. and 2, $L_1$ can be defined as the distance between rear surface 122 *a* of parition wall 122 and the forwardmost portion 373*a* of the first opening 373. With respect to control mechanism 36,distance $L_1$ is relatively small and is not designed with any consideration of the effect that $L_1$ has on the operation of the compressor. When the compressor first begins to transitions from maximum to reduced displacement,piston 372 viberates at a muximum amplitude,which can be defined by a length S (not shown).Length S can be determined,for example,by connecting a sensor to the piston or cylinder. In the compressor of FIG.1 and 2,length S is greater than distance $L_1$. As a result,annular shoulder portion 372 *a* of piston 372 strikes rear surface 122 *a* of partition wall 122,and does so with a relatively large force. The inpact stress caused by this repeated striking can damage the control mechanism components including partition wall 122 and piston 372. This damage can take the form of excessive abrasion,for example. Moreover, the vibration caused by the impact can be transmitted to other componets of the compressor, thereby potentially damaging those components. Also,the impact causes undersirable noise.

As a partial solution,ring member 61 is provided,as described above,on the rear surface 122 *a* of partition wall 122. Ring member 61 acts a buffer between piston 372 and partiton wall 122. Ring member 61 prevents control mechanism 36 from causing the impact noise and eccentric abrasion. In this arrangement,however,providing the necessary ring member 61 causes increased material costs and increased assembly time during manufacture of the compressor. Other problems exist with prior art compressor as will be understood by those having ordinary skill in the pertinent art.

SUMMARY OF THE INVENTION

Therefore,it is an object of the present invention to provide a fluid displacement apparatus which is simple in construction and production.

It is another object of the present invention to provide a fluid displacement apparatus for use in an automotive air conditioning system,wherein the apparatus has a variable displacement mecheniam which reduces vibrational noise.

It is another object of the present invention to provide a fluid displacement apparatus for use in an automotive air conditioning system,wherein the apparatus has a variable displacement mechanism which reduces wear and damage to the components of the compressor.

Accordingly,a mechanism is provided for controlling fluid communication between an intermediate pressure chamber and a suction chamber of a fluid displacement apparatus. the fluid displacement apparatus has a communication channel extending between the intermediate pressure chamber and athe suction chamber, and is operable between a maximum displacement and a reduced displacement. The mechanism includes a first valve element which has a cylinder defining a cylinder chamber therein,a side wall and a bottom wall. The side wall has a first opening formed therethrough to link the cylinder chamber and the intermediate pressure chamber. The bottom wall has a second opening formed therethrough to link the cylinder chamber and the suction chamber. The mechanism also includes a piston slidably disposed within the cylinder and moveable between a first position corresponding to the maximum displacement and a second position corresponding to the reduced displacement. The movement of the piston from the first postion to the second position is characteized by a vibration defining a maximum amplitude. The second valve element controls the movement of the piston in response to a change in a difference between a pressure in the discharge chamber and a pressure in the cylinder chamber. The distance between the bottom wall of the cylinder and a point of the first opening nearest the bottom wall is greater than the maximum amplitude of the piston movement.

A technical advantage of the present invention is that the piston is prevented from striking the bottom wall of the cylinder. Noise and damage to compressor components are prevented. Another technical advantage is that a buffer ring does not have to be provided between the piston and the bottom wall of the cylinder.

According to a feature of the invention,the first opening can have different shapes which affect the nature of the compressor's transition from maximum to reduced displacement.

Further object, features and advantages of this invention will be understood from the following detailed description of the preferred embodiments of this invention with reference to the appropriate figures.

BREIF DESCRIPTION OF THE DRAWINGS

FIG. 1 is a longitudianal sectional view of a scroll-type refrigerant compressor in accordance with the prior art.

FIG. 2. is an enlarged partial longitudinal sectional viw of a control mechanism of the scroll-type refrigerant compressor shown in FIG. 1.

FIG. 3. is an enlarged partial longitudinal sectional view of a control mechanism of the scroll-type refrigerant compressor in accordance with an embodiment of the present invention.

FIG. 4. is an enlarged partial cross-sectional view of the control mechanism of figure 3 taken along line 4—4 in Fig.3 and in accordance with an embodiment of the present invention.

FIG. 5. is an enlarged partial cross-sectional view of the control mechanism of figure 3 taken along line 4—4 in FIG. 3 and modified in accordance with an embodiment of the present invention.

FIG. 6. is an enlarged partial cross-sectional view of the control mechanism of FIG. 3 taken along line 4—4 in FIG. 3 and modified in accordance with an embodiment of the present invention.

DETAILED DESCRIPTION OF THE PREFERRED EMBODIMENTS

Figure 1:
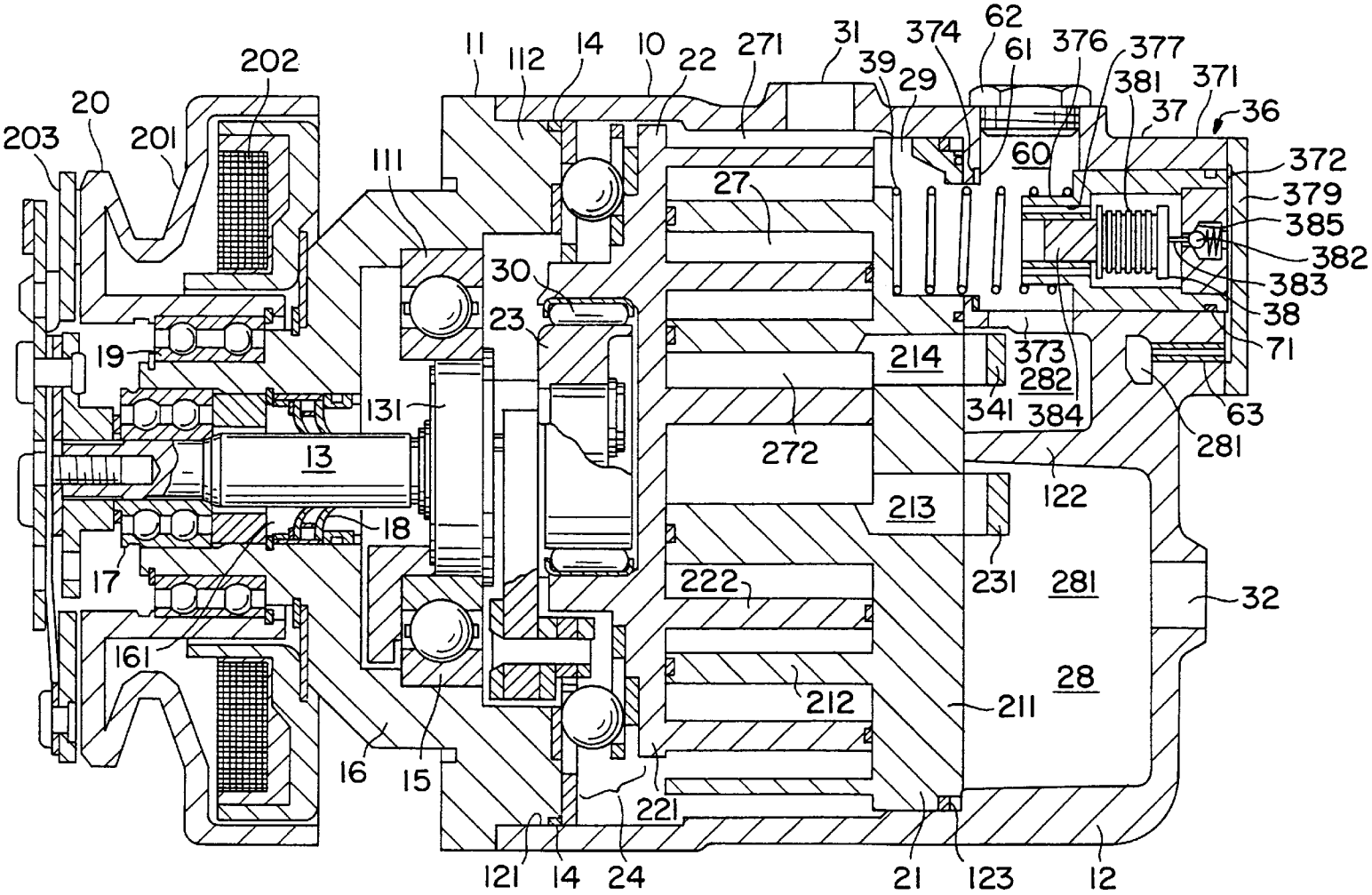
FIG. 1 (PRIOR ART)
Figure 2:
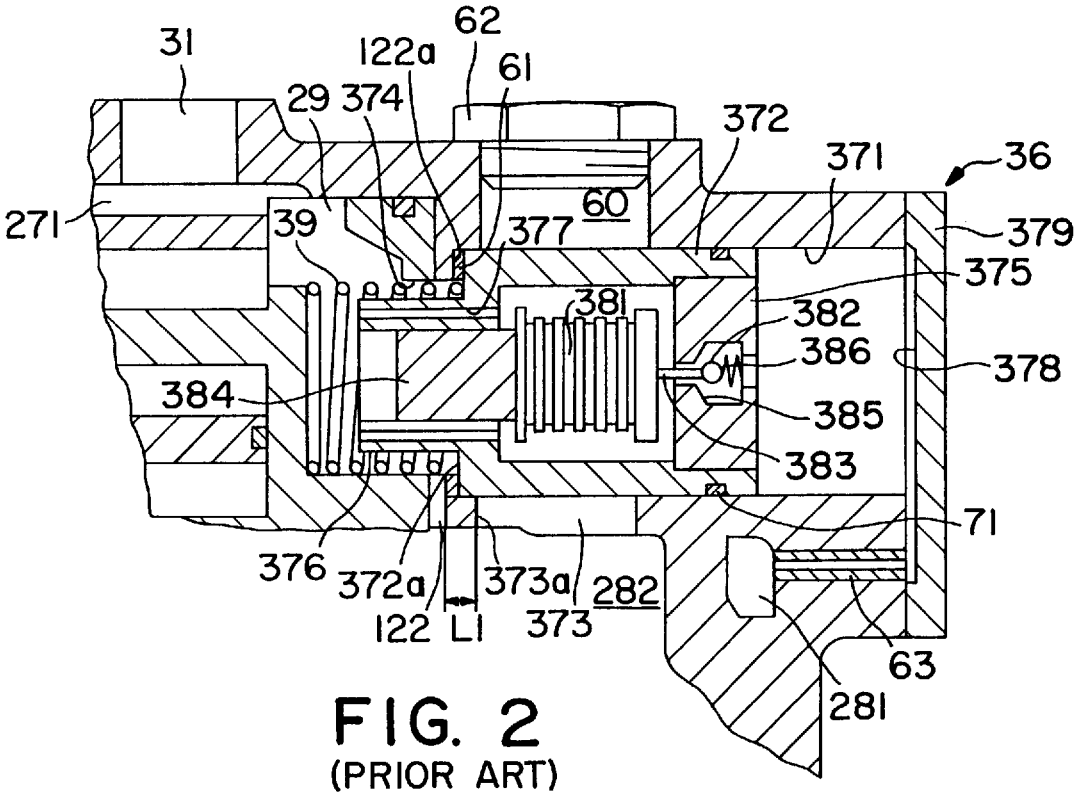
FIG. 2 (PRIOR ART)

The compressor of figures 3-6 are similar to the compressor shown in FIGS. 1 and 2,and similar elements have been given the same reference numerals. Some aspects of the operation of the compressors in figures 3-6 are similar to those of the compressor in FIGS. 1 and 2. A detailed description of these similar aspects is not necessary to understanding the present invention and therefore,is omitted. Also,merely for convenience,the left side of FIGS. 1–6 is referred to as the front or forward side and the right side is referred to as the rear or rearward side.

Figure 3:
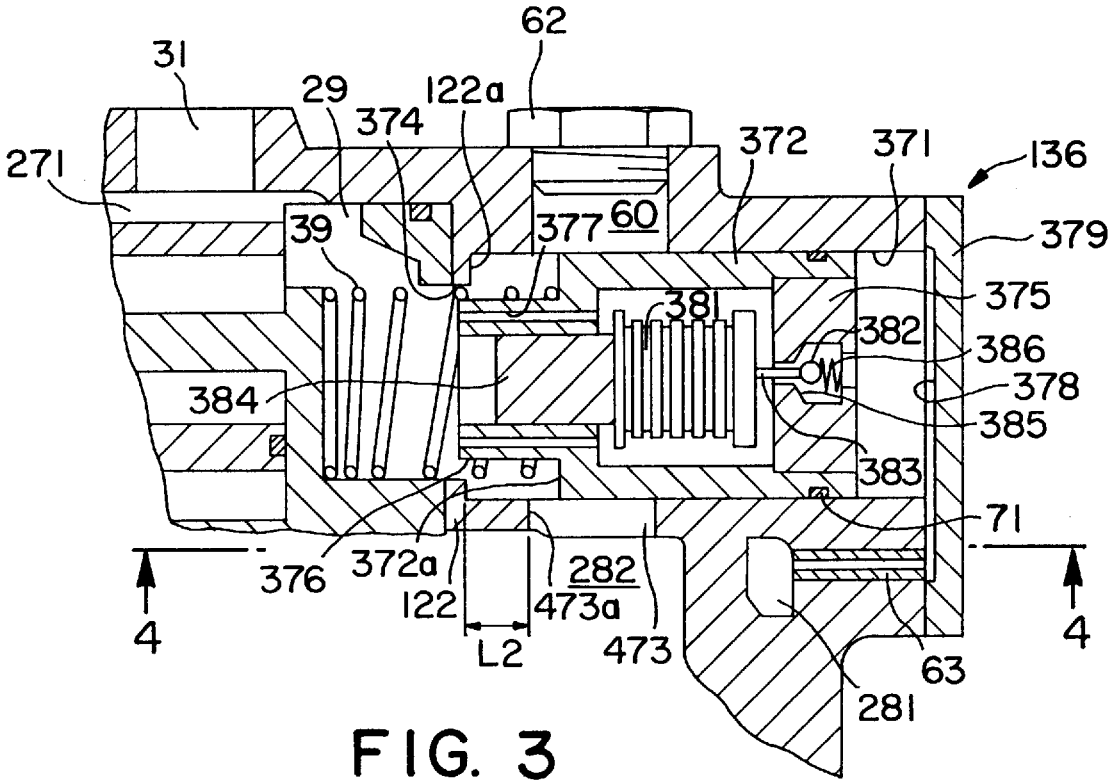
Figure 4:
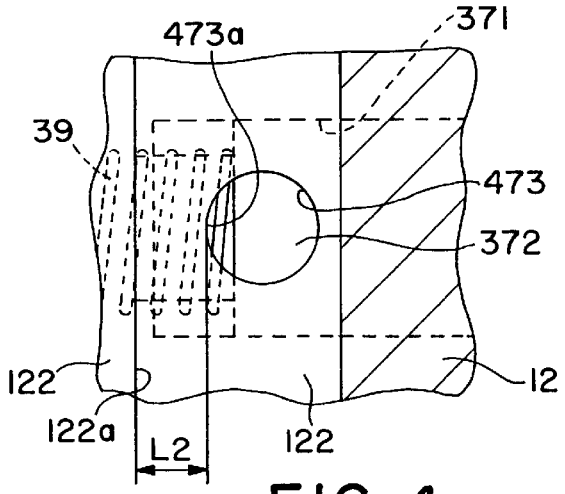

Referring to Figures 3 and 4,a control mechanism 136 for a fluid displacement apparatus(e.g.,a scroll-type refrigerant compressor)is shown in accordance with an embodiment of the present invention. Partition wall 122 of cup-shaped casing 12 has a first opening 473 formed therethrough to provide communication between intermediate pressure chamber 282 and suction chamber 271. First opening 473 is formed to be circular-shaped in axial cross section so that the longitudinal acis of circular-shape first opening 473 intersects the longitudinal axis of cylinder 371. $L_2$ is shown as the disrance between rear surface 122 *a* of partition wall 122 and the forwardmost portion 473 *a* of first opening 473. As discussed above,during operation of the compressor,piston 372 axially vibrates when the compressor transistions from maximum to reduced displacement. When the transition first begins,the axial vibration of piston 372 is at a maximum amplitude S.Distance $L_2$ is designed to be greater than maximum amplitude S.

Consequently,annular shoulder portion 372 *a* of piston 372 does not strike rear surface 122 *a* of partition wall 122 when the transitional vibration of piston 372 is at a maximum amplitude. As the compressor continues to operate,the vibrational amplitude of piston 372 gradually decreases to zero and athe compressor functions normally at the reduced displacement. Control mechanism 136 thus does not requirea ring member 61 to prevent impact noise and the eccentric abrasion as suffered by prior art compressors. Also,manufacturing costs are reduced and the compressor assembly is simplified.

Figure 5:
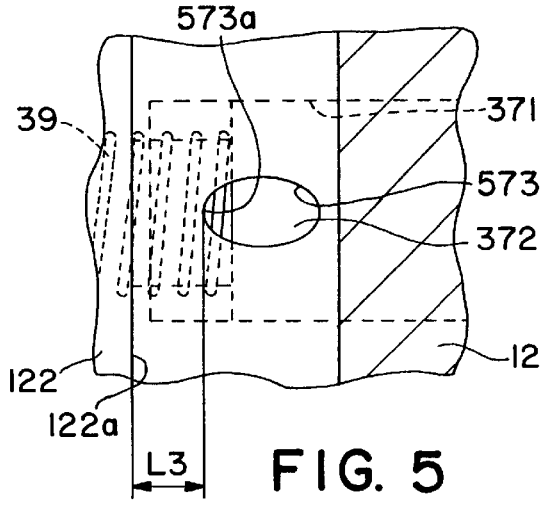

Referring to Figure 5,a control mechanism 236 is shown according to a second embodiment of the present invention. Control mechanism 236 is generally similar to control mechanism 136 described above. However,some differences do exist as follows. For example, in control mechanism 236,first opening 573 is formed to be elliptical-shaped in axial cross section so that the longitudinal axis of first opening 573 intersects the longitudinal axis of cylinder 371. $L_3$ is shown as the distance between rear surface 122 *a* of partition wall 122 and the forwardmost portion 573 *a* of the opening 573. Distance $L_3$ is designed to be larger than maximum amplitude S. Similar results are achieved as described above in connection with the previous embodiment. However,the elliptical shape has a different effect on the characteristics of the transition from maximum to reduced displacement. For example,the elliptical-shaped opening can have the same cross-sectional area as the circular opening,but simultaneously is longer in the axial direction of the cylinder. Therefore,the transition vibration is less violent and more gradual than with the circular opening.

Figure 6:
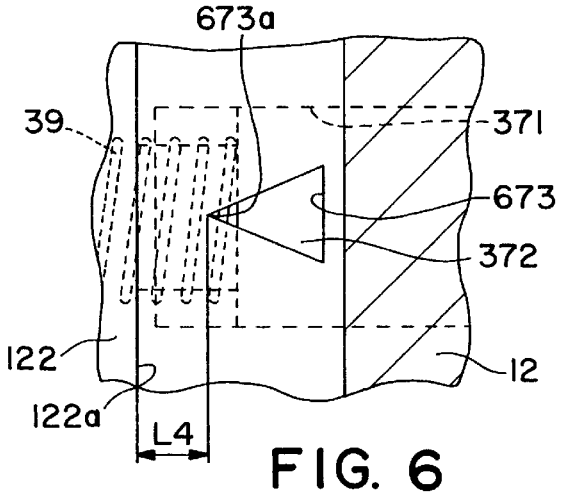

Referring to Figure 6,a control mechanism 336 is shown according to a third embodiment of the present invention. Control mechanism 336 is generally similar to control mechanisms 136 and 236 described above. However,some differences do exist as follows. For example,in control mechanism 336,first opening 673 is formed to be triangular-shaped in axial cross section so that the longitudinal axis of first opening 673 intersects the longitudinal axis of cylinder 371. $L_4$ is shown as the distance between rear surface 122 *a* of partition wall 122 and the forwardmost portion 673 *a* of first opening 673. Distance $L_4$ is designed to be larger than maximum amplitude S.Similar results are achieved as described above in connection with the previous embodiments. However,the shape of first opening 673 affects the transition from maximum to reduced displacement differently than the circular or elliptical openings described above. For example,the triangular opening can have the same cross-sectional area as the circular or elliptical openings. However,the triangular opening has a smaller cross-sectional area when it the opening is partially blocked as compared to a partially blocked elliptical opening,for example. Thus,the nature of the transition from maximum to reduced displacement can be manipulated by changing the shape of the first opening.

Although the present invention has been described in connection with the preferred embodiment,the invention is not limited thereto. It will be easily understood by those of ordinary skill in the art that variations and modifications can be easily made without departing from the scope and spirit of the present invention as defined by the following claims.

What is claimed is:

1. A mechanism for controlling fluid communication between an intermediate pressure chamber and a suction chamber of a fluid displace apparatus, wherin the fluid displacement apparatus has a discharge chamber and a communication channel extending between the intermediate presence chamber and the suction chamber, the fluid displacement apparatus being operable between a maximum displacement and a reduced displacement,the mechanism comprising.

2. The mechanism of claim 1, wherein said first valve element further comprises a biasing member extending through the second opening and contacting the piston for biasing the piston away from the second opening.

3. The mechanism of claim 1,wherein the fluid displacement apparatus also has a discharge chamber and wherein the second valve element comprises a bellows disposed within an interior of the piston to the discharge chamber and a second hole linking the interior of the piston to the discharge chamber and a second hole linking the interior of the piston to the communication channel, the bellows being responsive to a pressure in the communication channel to open and close the first hole.

4. The mechanism of claim 3,wherein the second valve element further comprises a screw member coupled to the bellows opposite the valve memeber, the screw elemrnt being coupled to the piston,the screw member being adjustable to adjust a positon of the bellows within the interior of the piston.

5. The mechnaism of claim 1,wherein the fluid displacement apparatus also has a discharge chamber,and wherein the first valbe element further comprises an orifice tube for linking the cylinder to the discharge chamber.

6. The mechanism of claim 1,wherein the first opening is formed t have a circular-shaped axial cross section.

7. The mechanism of claim 1,wherein the first opening is formed to have an ellipsitcal-shaped axial cross section.

8. The mechanism of claim 1,wherein the first opening is formed to have a triangular-shaped axial cross section.

* * * * *